US005305612A

United States Patent [19]

Higham et al.

[11] Patent Number: 5,305,612

[45] Date of Patent: Apr. 26, 1994

[54] CRYOPUMP METHOD AND APPARATUS

[75] Inventors: Graham J. Higham, Contra Costra; Craig Perkins, Santa Clara County, both of Calif.

[73] Assignee: Ebara Technologies Incorporated, Santa Clara, Calif.

[21] Appl. No.: 988,708

[22] Filed: Dec. 10, 1992

Related U.S. Application Data

[63] Continuation-in-part of Ser. No. 908,401, Jul. 6, 1992, abandoned.

[51] Int. Cl.[5] ..... B01D 8/00

[52] U.S. Cl. ..... 62/55.5; 62/383

[58] Field of Search ..... 62/55.5, 383; 55/268; 417/901

[56] References Cited

U.S. PATENT DOCUMENTS

| | | | |
|---|---|---|---|
| 3,721,101 | 3/1973 | Sheppard et al. | 62/55.5 X |
| 4,356,701 | 11/1982 | Bartlett et al. | 417/901 X |
| 4,438,632 | 3/1984 | Lessard et al. | 62/383 X |
| 4,763,483 | 5/1988 | Olsen | 62/383 X |
| 4,953,359 | 9/1990 | Forth et al. . | |
| 5,111,667 | 5/1992 | Häfner | 62/55.5 |

FOREIGN PATENT DOCUMENTS

| | | | |
|---|---|---|---|
| 0186075 | 11/1982 | Japan | 417/901 |
| 0131381 | 8/1983 | Japan | 417/901 |
| 0195390 | 10/1985 | Japan | 62/55.5 |
| 0124880 | 5/1988 | Japan | 62/55.5 |
| 0652804 | 11/1985 | Switzerland | 62/55.5 |
| 1622620 | 1/1991 | U.S.S.R. | 62/55.5 |

*Primary Examiner*—Henry A. Bennet
*Assistant Examiner*—Christopher B. Kilner
*Attorney, Agent, or Firm*—Stanley Z. Cole

[57] ABSTRACT

Cryopump apparatus and method for controlling the operating temperature of a cryoarray in a cryopump. The cryopump has means for thermally isolating one of more of the cryoarrays from the refrigeration source. The means for thermally isolating is a thermal switch formed from at least first and second switch elements made of materials having dissimilar coefficients of thermal expansion. The thermal switch is also used in isolating one of the pump's cryoarrays during a partial regeneration process. The thermal switch of the preferred embodiment may also be used to prevent one of the pump's cryoarrays from falling below a predetermined operating temperature.

10 Claims, 4 Drawing Sheets

CRYOPUMP METHOD AND APPARATUS

FIELD OF THE INVENTION

This invention is a continuation-in-part of a previously filed, copending patent application identified as Ser. No. 07/908,401 entitled CRYOPUMP REGENERATION METHOD AND APPARATUS filed Jul. 6, 1992, now abandoned.

This invention is directed toward a new method and apparatus for the creation and maintenance of a vacuum using a cryogenic vacuum pump (cryopump). The invention relates specifically to the use of noninvasive means for independent and separate thermal isolation of the first and/or second stages of the pump from the refrigeration source.

BACKGROUND OF THE INVENTION

Cryogenic vacuum pumps (cryopumps) are widely used in high vacuum applications. Cryopumps remove gases from a vacuum chamber by cooling the gases and then binding the gases to cold surfaces inside the pump. Cryocondensation, cryosorption and cryotrapping are the basic mechanisms that can be involved in the operation of a cryopump. In cryocondensation, gas molecules are condensed on previously condensed gas molecules. Thick layers of condensate can be formed, thereby pumping large quantities of gas.

Cryopumps are widely used for applications where contamination by non-process gases such as hydrocarbons must be avoided. Cryopumps typically use a closed loop helium refrigerator. Refrigeration is produced in a first stage operating at 50 to 80 degrees K and a second stage at 10 to 20 degrees K. Conducting metal surfaces called cryoarrays are attached to the refrigerator stages and are cooled thereby. Easily condensed gases, such as water vapor, argon, nitrogen and oxygen, are pumped by cryocondensation on the first and second stage cryoarrays. However, the lowest temperature achievable in a refrigerator cooled cryopump is sufficiently high (about 10° Kelvin) that not all gases normally present in a vacuum system can be pumped by cryocondensation. The gases which are difficult to condense, such as hydrogen, helium and neon, must be pumped by cryosorption. For this purpose, a sorbent material such as activated charcoal is attached to the second stage cryoarray. Further, only relatively low amounts of gas can be pumped by cryosorption, as only a thin layer (up to about 5 monolayers) can be formed on the surfaces of the sorbent material.

Cryopump applications are requiring the first stage of the cryopump to be maintained at a particular and uniform temperature. One cryopump attempts to meet this requirement by providing a heater in thermal contact with the first stage cryoarray. The heater works against the action of the refrigeration source by adding heat to the first stage to maintain a predetermined temperature, as measured by a temperature sensor.

The use of heaters to maintain the temperature of the first stage array detracts from the overall efficiency of cryopumps in several ways. First, the heat applied to the first stage cryoarray adds to the cooling load of the refrigeration source. In addition, heat added to the first stage can degrade the operational conditions of the second stage by raising its temperature, thereby reducing the pump's overall efficiency. Finally, the power used to operate the heater adds to the power needed to operate the entire cryopump system, thereby making the system less energy efficient.

Ultimately there is a limit to the amount of gases that can be pumped by a cryopump, necessitating a need for the pump to be regenerated. The usual process for regeneration involves decoupling the cryopump system from the chamber it is pumping, deactivating the refrigerating system, and allowing the cold surfaces within the pump to warm and release captured gases. Once the gases are released and vented from the vacuum system, a secondary roughing pump is used to restart the vacuum pump-down. After a suitable vacuum level is achieved, the cryopump is restarted by reactivating the refrigerator to recool the internal surfaces so that the internal mechanism can recommence the normal operation of cryopumping. This regeneration process of boiling off and venting the contaminant gases and reestablishing normal vacuum conditions for cryopump operation usually takes several hours, and the time consumed this way prevents the use of the pump for its intended purposes.

U.S. Pat. No. 4,763,483, although primarily concerned with pump-down concept, discloses the regeneration of the cryopump through the movement of the cooling segments of each stage away from the cryoarrays of each stage while the refrigeration system continues to function. The pump is then brought on-line by starting the first stage and bringing it to a certain level of operation at which time the second stage is reconnected and made operational.

It is an object of this invention to provide a cryopump having an isolation mechanism for temporarily breaking the thermal contact between the refrigerating system and one or more of the arrays of the cryopump. It is a further object of this invention to use a thermal isolation mechanism to perform a partial regeneration by only regenerating the condensed gases on the second stage array of the cryopump. It is yet a still further object of this invention to be able to do a partial or full regeneration by choice using the techniques of this invention. It is yet another object of this invention to provide an isolation mechanism for automatic and noninvasive temperature control of the first array of a cryopump.

SUMMARY OF THE INVENTION

According to the present invention, these and other objectives and advantages are achieved. Apparatus in accordance with this invention comprises a cryogenic pumping device having an associated cryoarray isolation mechanism to thermally connect or isolate the refrigeration or cooling means from the condensing arrays of the cryopump. More particularly, the isolation mechanism is structured to isolate the cooling means from the pump's second array at a time when the temperature of the array is increasing during regeneration. This is accomplished through the combined use of a thermal shrink fit switch between the second cryoarray and the cooling means based on the dissimilar expansion coefficients of two dissimilar materials and actual movement of the cryoarray away from the cooling means. When the gases have been released from the cryoarray and vented, thermal contact is reestablished by reversing the effect of the thermal shrink fit switch and by moving the cryoarray back to the cooling means, as more fully described hereinafter.

The isolation mechanism also isolates the cryopump's first array from the cooling means if the temperature of the first array drops below a predetermined temperature. This is accomplished through the use of a second thermal shrink fit switch to isolate the first cryoarray from the cooling means. When the temperature of the first array rises above the predetermined temperature, the thermal switch reestablishes contact between the first cryoarray and the cooling means, as explained more fully below.

DETAILED DESCRIPTION OF THE DRAWINGS

Figure 1:
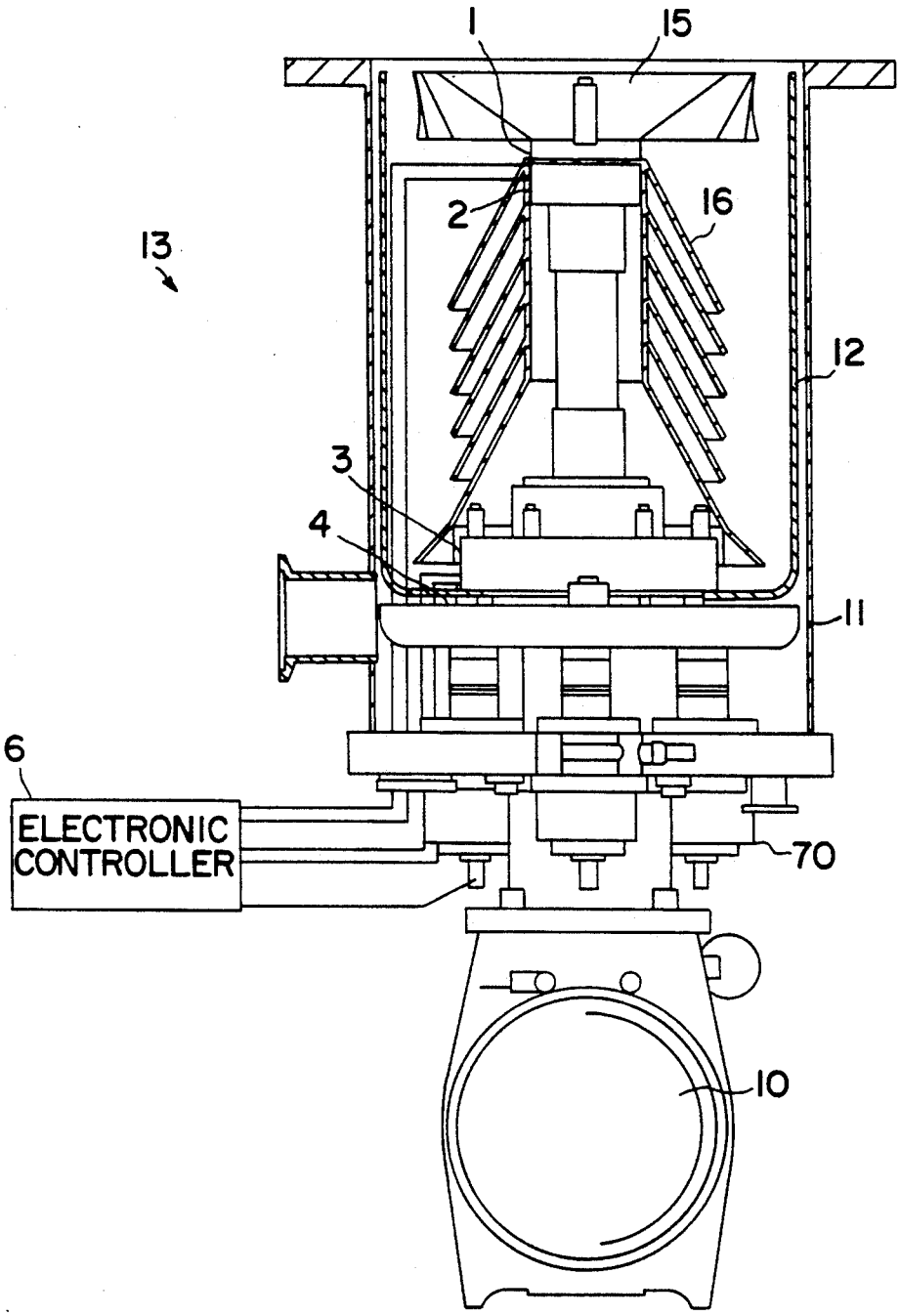
FIG. 1 is a schematic illustration of a cryopump according to the preferred embodiment of this invention.
Figure 2:
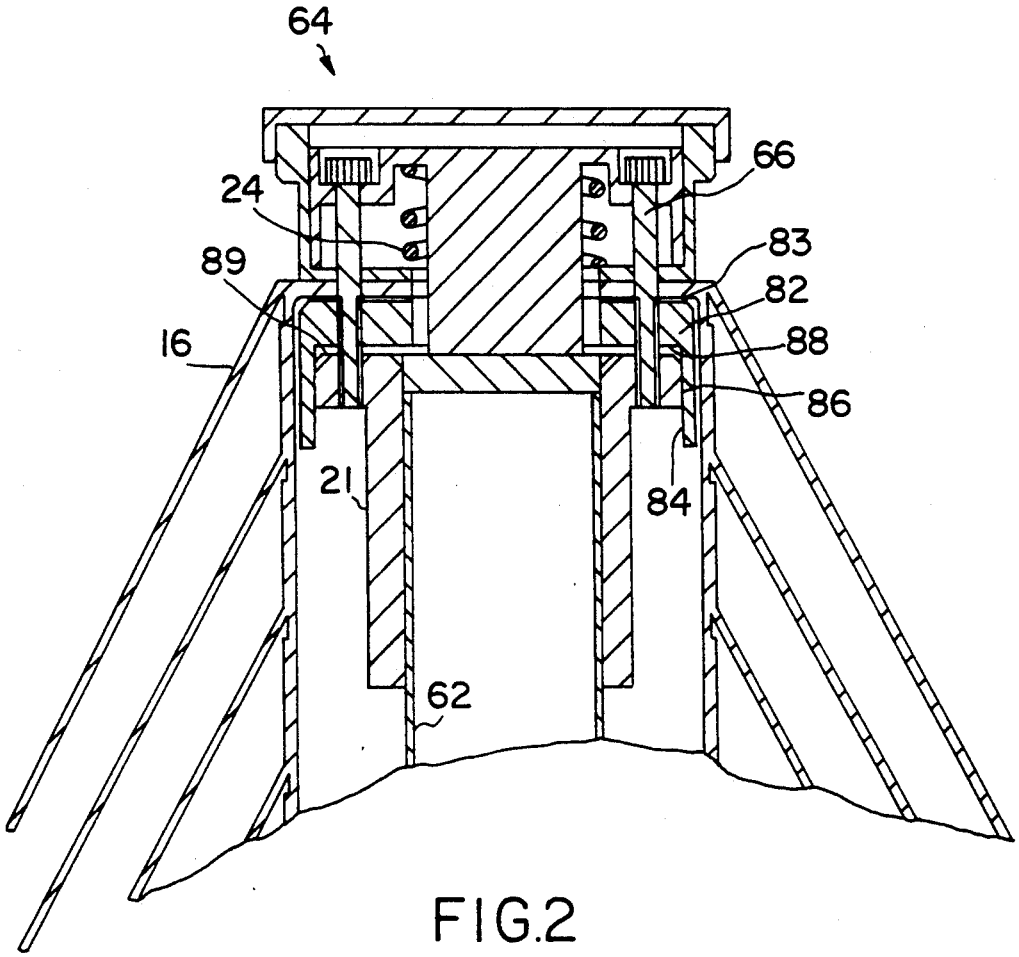
FIG. 2 is a sectional view of part of the second stage cryoarray isolation mechanism.

Referring now to FIGS. 1 and 2, there is shown a two stage mechanically refrigerated cryopump 13 comprising a two stage refrigeration apparatus 10, a first stage cryoarray 12 and 15 and a second stage cryoarray 16 and a vacuum vessel 11. Cryopump 13 may be a commercially available cryopump such as a model FS-8LP manufactured and sold by Ebara Technologies Incorporated, with modifications and additions as described below. The refrigeration apparatus 10 operates as a closed loop refrigeration system in which compressed helium gas is allowed to expand at two locations. A compressor (which is the mechanism whereby the helium is compressed) is not shown but conforms to a typical compressor used in this art and is typically located remote from the pumping apparatus 13. Vacuum enclosure 11 is connected to a flange mounted on the refrigerating apparatus 10 and encloses within a housing or enclosure 11 cryoarrays 15 and 16. A radiation shield 12 protects the second stage from radiational heating generated by the vacuum enclosure 11. Radiation shield 12 also acts as part of the cryoarray 15.

Temperature diodes 1 and 2 are positioned on cryoarray assembly 16 and respectively measure the temperature of cryoarray 16 and the second stage temperature of pump 13. Similarly, temperature diodes 3 and 4 respectively measure the temperature of cryoarray 15 and the first stage of pump 13. All four temperature diodes are connected to an electronic controller 6. A pressure relief valve (not shown) is connected to vacuum enclosure 11.

As shown in FIG. 2, a refrigerator mounting flange 21 surrounds the second refrigeration apparatus stage 62. Flange 21 is attached to a thermal transfer collar 82 to provide thermal contact between the refrigeration apparatus and the cryoarray 16 as explained further below. An indium washer 83 may be placed between collar 82 and array 16 to improve the thermal contact between these two elements. In the preferred embodiment, the attachment means comprises a series of bolts 66 and a spring 24 (such as a helical spring or a belleville washer) which biases mounting flange 21 toward collar 82 so that lower surface 88 of collar 82 comes into contact with upper surface 89 of mounting flange 21. Other means of mechanically attaching cryoarray 16 to the refrigeration apparatus may be used without departing from the invention.

This invention provides a thermal isolation mechanism to selectively thermally isolate and thermally connect collar 82 to flange 21 and cryoarray 16. Flange 21 and collar 82 are made of dissimilar materials having dissimilar thermal expansion coefficients. For example, in the preferred embodiment, flange 21 is formed from copper, and collar 82 is formed from aluminum. During manufacturing, the outer diameter of &lange 21 is made slightly smaller than the inner diameter of collar 82 so that the two elements are not in contact at room temperature or at a predetermined pump regeneration temperature. As the two elements cool down towards the operating temperature of the pump's second stage, collar 82 will contract more than mounting flange 21, thereby providing a radial shrink fit between inner surface 84 of collar 82 and outer surface 86 of flange 21 at the operating temperature to provide good thermal contact between the two elements. The room ambient temperature clearance between the inner surface 84 of collar 82 and the outer surface 86 of mounting flange 21 dictate the transition contact temperature (i.e., the temperature at which these two surfaces meet). This initial clearance also determines the interference pressure between these two surfaces at the pump's normal operating temperature and hence dictates the degree of thermal contact between these two elements. If, however, collar 82 and mounting flange 21 are heated to the pump's regeneration temperature, collar 82 will expand to a greater extent than flange 21 to break contact between surface 84 of collar 82 and surface 86 of flange 21, thereby thermally isolating cryoarray 16 from the refrigeration source.

Figure 3:
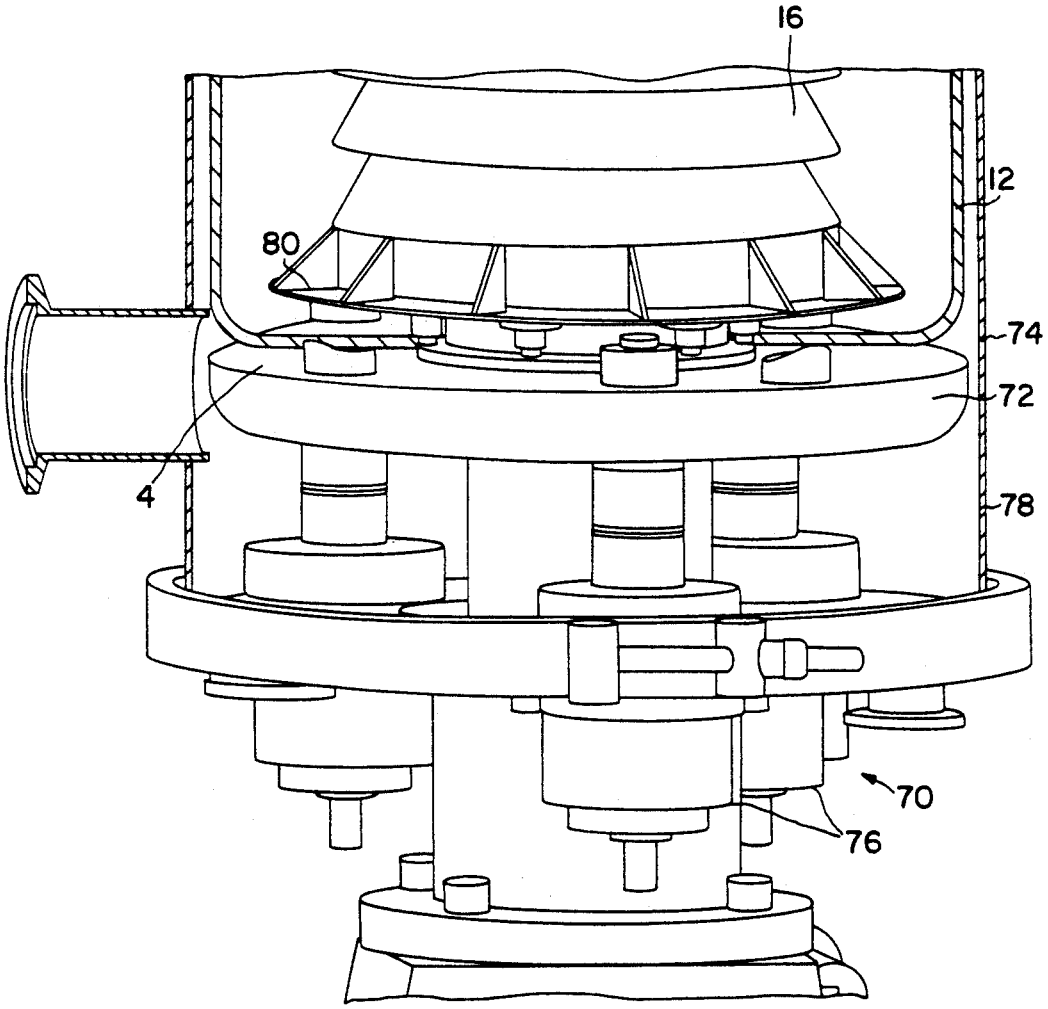
FIG. 3 is a schematic sectional view of the second stage cryoarray isolation mechanism actuator.

FIGS. 1 and 3 show the preferred embodiment of isolation assembly actuator 70. One or more heater probes 74 attach to and extend through a collection tray 72. In the preferred embodiment, three probes 74 are used. Probes 74 are heated by electrical resistance elements located in the portion of probe 74 extending below tray 72. Each probe 74 is connected to a digital linear actuator 76 by a lead screw surrounded by an expandable bellows 78 and extending through the bottom of vacuum vessel 11.

In a partial regeneration process, a gate valve between cryopump 13 and the system being maintained under vacuum is closed. Probes 74 then heat tray 72 to a prescribed temperature which is dependent upon the application of the system. When temperature sensor 4 in tray 72 indicates that the prescribed temperature has been reached, the heater probes 74 and collection tray 72 are raised upward by the actuators 76 until probes 74 pass through holes in radiation shield 12 to come into contact with the bottom flange 80 of cryoarray 16. Actuators 76 are preferably digital linear actuators driven by stepper motors. The expandable bellows 78 surrounds the actuator arm as it moves probes 74 into and away from radiation shield 12.

As cryoarray 16 heats up, refrigerator flange 21 (FIG. 2) and thermal transfer collar 82 (FIG. 2) expand, as discussed above. Because their thermal expansion coefficients are dissimilar, collar 82 expands more than flange 21, thereby breaking contact between these two elements at a predetermined pump regeneration temperature.

A predetermined temperature may be determined and set at the time of manufacture through the selection of the collar's inner diameter and the refrigerator flange's outer diameter. The upward force of the actuators 76 against the bias of springs 24 (FIG. 2) move the entire cryoarray 16 and attachment assembly 64 upward a slight amount, thereby breaking thermal contact between surfaces 89 (FIG. 2) and 86 (FIG. 2) of mounting flange 21 and surfaces 84 and 88 of collar 82. Cryoarray 16 is now thermally isolated from the refrigeration means. The first stage cryoarray is still thermally connected to the refrigeration means, however, and continues to operate at its prescribed temperature.

As cryoarray 16 heats up, the solidified gases deposited thereon (such as argon) fall to the bottom of shield 12, where they melt (providing additional refrigeration for the first stage cryoarray in the process). The liquid cryogens drain into collection tray 72 where they boil and vent out of the system through the pressure relief valve. When temperture sensor 2, attached to cryoarray 16 indicates that it has reached a prescribed temperature, a roughing pump is activated to bring the internal pressure within the cryopump 10 down to a normal cryopump operational level. The heating elements of probes 74 are switched off, and actuators 76 lower probes 74 and collection tray 72 to their starting position. Cryopump 13 on attaining an acceptable vacuum pressure is then reconnected to the system requiring a vacuum. There is no need to restart the refrigeration system; it runs continuously throughout the partial regeneration process providing refrigeration to the first stage cryoarray. Thus, the refrigeration system and first stage cryoarray are maintained at or near their normal operational temperature thereby minimizing the time needed for regeneration and for return to normal operation.

Modifications of the preferred embodiment will be apparent to those skilled in the art. For example, if the shrink fit connection between the refrigerator flange and the second stage cryoarray is not machined with appropriate accuracy, then the temperature at which the thermal switch will operate will vary from pump to pump and from a desired temperature. Efforts to machine parts with great accuracy, plate parts for appropriate surface qualitites and the like will contribute to conformance by the pump with preselected temperatures and from pump to pump. However, to assure operations as described, one can use heat control at the point of fit or alternatively speed control systems to adjust the speed of operation of the refrigerator pump for deviations.

Figure 4:
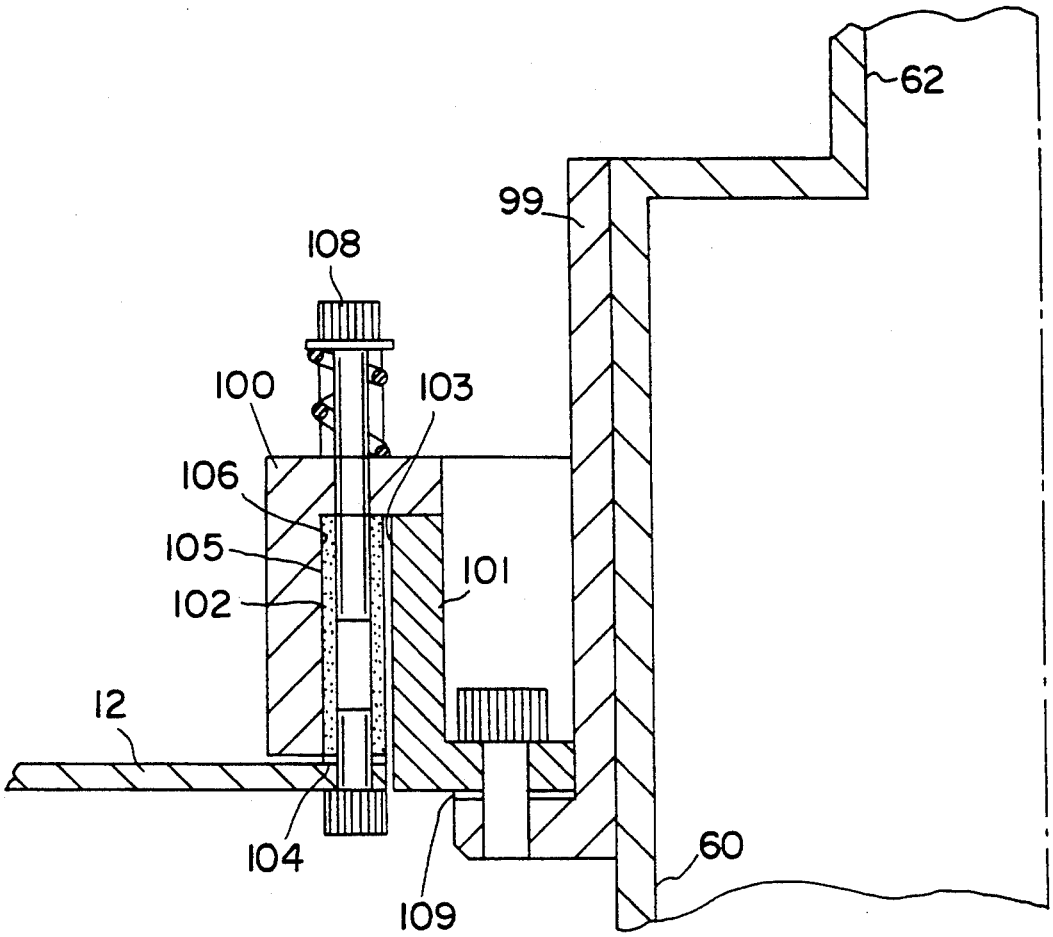
FIG. 4 is a sectional view of the first stage cryoarray isolation mechanism.

FIG. 4 shows the first stage thermal isolation mechanism used for temperature control. Thermal conduction between cryoarray 15 and the first stage 60 of refrigeration apparatus 10 is provided by a refrigerator mounting flange 99 and a two-piece first stage collar 100 and 101. An indium washer 109 may be placed between the two-piece first stage collar 100, 101 and the refrigerator mounting flange 99 to improve thermal contact. In the preferred embodiment, collar 100, 101 is made of copper. A thermal transfer ring 102 is disposed in a groove 103 within two-piece collar 100, 101. In the preferred embodiment, ring 102 is formed from aluminum. Other materials may be used for the collar and ring without departing from the scope of the invention. An indium ring 104 may be placed between thermal transfer ring 102 and radiation shield 12 to improve the thermal contact between these two elements.

Because they are formed from dissimilar materials, thermal transfer ring 102 and collar 100, 101 act as a thermal isolation switch to break thermal contact between the refrigeration means and the first stage cryoarray at a predetermined temperature. When at room ambient temperature and down to a predetermined first stage operating temperature, the inner surface 106 of collar element 100 and the outer surface 105 of ring 102 are in thermal contact. If, however, the temperature of ring 102 and collar element 100 falls below the predetermined temperature, the diameter of surface 105 of aluminum ring 102 will become smaller than the diameter of surface 106 of collar element 100, thereby breaking thermal contact between the refrigeration means and the first stage cryoarray. When the temperature of the ring and collar go back up to the predetermined temperature, thermal contact between the refrigeration means and cryoarray is reestablished. Thus, ring 102 and collar 100, 101 act as a thermal switch between the refrigeration means and the cryoarray. Here too precautions are required to machine surfaces to assure fit and in some instances there is value to including an ability to heat to assure operation of the thermal switch at the appropriate time.

Collar 100, 101, and ring 102 are held in place at all temperatures by a series of spring-biased bolts 108. Thus, even when the thermal switch described above breaks thermal contact between surfaces 105 and 106 of the collar and ring, respectively, the spring action of the bolts 108 maintains mechanical integrity and provides a minimal degree of thermal contact between the top of ring 102 and the inside bottom surface of collar element 100. This minimal thermal contact is insufficient to overcome the loss of thermal contact due to operation of the thermal switch.

While this invention has been described in terms of specific embodiments, it should be understood that it may be practiced with variations and equivalents as will readily occur to those skilled in the art. Thus, the foregoing description is to be construed as illustrative with the invention being defined in terms of the following claims.

What is claimed is:

1. A cryopump comprising: refrigeration means; first and second cryoarrays; means for thermally isolating and thermally reconnecting the first cryoarray and the refrigeration means without isolating the second cryoarray from the refrigeration means; said means for thermally isolating and thermally reconnecting comprising a thermal shrink fit switch formed from at least first and second switch elements made of materials having dissimilar coefficients of thermal expansion.

2. The cryopump of claim 1 wherein the first switch element of the thermal switch is in thermal contact with the refrigeration means.

3. The cryopump of claim 2 wherein the second switch element of the thermal switch is in thermal contact with the first cryoarray.

4. The cryopump of claim 1 further comprising means for thermally isolating the second cryoarray from the refrigeration means without isolating the first cryoarray from the refrigeration means; the means for thermally isolating including means for thermally reconnecting the second cryoarray to the refrigeration means.

5. The cryopump of claim 4 wherein the means for thermally isolating the second cryoarray comprises a thermal shrink fit switch formed from at least first and second switch elements made of materials having dissimilar coefficients of thermal expansion.

6. The cryopump of claim 5 (wherein the) including means (as provided) for applying heat to the second stage cryoarray by isolating said array at a predetermined temperature by means of said thermal shrink fit switch.

7. A cryopump in accordance with claim 5 including means to move the second stage cryoarray apart from other elements as to physically separate and thermally isolate said cryoarray from said refrigeration means.

8. The cryopump of claim 4 wherein the means for thermally isolating the second cryoarray comprises means for moving the second cryoarray with respect to the refrigeration means.

9. A cryopump comprising a refrigeration means; a cryoarray; means for providing thermal conduction between the refrigeration means and the cryoarray; and thermal shrink fit switch means of two dissimilar materials in a shrink fit relationship for thermally isolating the cryoarray from the refrigeration means to prevent thermal conduction between the refrigeration means and the cryoarray when the thermal switch (comprises two dissimilar materials in a shrink fit relationship) is in an open position in which said dissimilar materials are separated at a predetermined temperature.

10. A method of regenerating a two stage cryopump comprising thermally isolating the second stage cryoarray of said cryopump from the pump refrigeration system using a thermal shrink fit switch formed from at least first and second switch elements made of materials having dissimilar coefficients of thermal expansion, releasing deposited gases from said second stage cryoarray while continuing operation of said refrigeration system, venting said released gases, and then thermally reconnecting said operating refrigeration system with said second stage cryoarray by closely coupling said dissimilar materials with one another.

* * * * *